US009278769B2

(12) United States Patent
Janssens et al.

(10) Patent No.: US 9,278,769 B2
(45) Date of Patent: Mar. 8, 2016

(54) FILLING SYSTEM AND FILLING METHOD

(71) Applicant: SARTORIUS LAB INSTRUMENTS GMBH & CO. KG, Goettingen (DE)

(72) Inventors: Paul Janssens, Hoboken (BE); Michael Mueller, Goettingen (DE); Jean-Pierre Decheneux, Mont Comblain (BE); Swen Weitemeier, Loedingsen (DE); Michael Fiedler, Osterode am Harz (DE); Steffen Strietzel, Siemerode (DE)

(73) Assignee: Sartorius Lab Instruments GmbH & Co. KG, Goettingen (DE)

( * ) Notice: Subject to any disclaimer, the term of this patent is extended or adjusted under 35 U.S.C. 154(b) by 145 days.

(21) Appl. No.: 14/041,323

(22) Filed: Sep. 30, 2013

(65) Prior Publication Data

US 2014/0027010 A1 Jan. 30, 2014

Related U.S. Application Data

(63) Continuation of application No. PCT/EP2012/001141, filed on Mar. 14, 2012.

(30) Foreign Application Priority Data

Mar. 28, 2011 (DE) ..... 10 2011 001 584

(51) Int. Cl.

| | |
|---|---|
| ***B65B 3/04*** | (2006.01) |
| ***B65B 3/14*** | (2006.01) |
| ***B65B 3/00*** | (2006.01) |
| ***B65B 3/28*** | (2006.01) |

(52) U.S. Cl.

CPC . *B65B 3/14* (2013.01); *B65B 3/003* (2013.01); *B65B 3/28* (2013.01); *B65B 2210/06* (2013.01)

(58) Field of Classification Search

CPC ..... B65B 3/003; B65B 3/12; B65B 3/14; B65B 2210/06

USPC ..... 141/10, 67–68, 114, 285, 302, 305, 141/313–314, 317

See application file for complete search history.

(56) References Cited

U.S. PATENT DOCUMENTS

| | | | | |
|---|---|---|---|---|
| 2,791,353 | A * | 5/1957 | Dorn et al. | 222/205 |
| 5,522,439 | A * | 6/1996 | Hakansson et al. | 141/244 |
| 2003/0230521 | A1 * | 12/2003 | Schick | 210/110 |
| 2004/0155066 | A1 * | 8/2004 | Schick | 222/190 |

(Continued)

FOREIGN PATENT DOCUMENTS

| | | | |
|---|---|---|---|
| DE | 132 568 | C | 11/1901 |
| DE | 43 41 934 | A1 | 6/1995 |
| DE | 693 11 321 | T2 | 1/1998 |
| DE | 196 40 664 | C1 | 2/1998 |
| EP | 0 632 775 | A1 | 1/1995 |
| EP | 1 525 138 | B1 | 12/2008 |

(Continued)

*Primary Examiner* — Nicolas A Arnett

(74) *Attorney, Agent, or Firm* — Edell, Shapiro & Finnan, LLC

(57) ABSTRACT

A filling system has a filling apparatus (200) and a container arrangement inserted into the filling apparatus. A main line includes a feed line (102), connected to a supply container (304), and a trunk line (104), connected linearly downstream of the feed line (102). Outside the trunk line (104), at a branching point (114), a branch line (116) branches from the main line (102) to a compressed-gas source (306), and the main line (102) and the branch line (116), on that side of the branching point (114) which is directed away from the trunk line, pass through a double-valve arrangement (214) having two hose-clamping valves (214*a*, 214*b*) controlled oppositely to one another.

7 Claims, 1 Drawing Sheet

(56) References Cited

U.S. PATENT DOCUMENTS

| | | | | |
|---|---|---|---|---|
| 2010/0236340 | A1 | 9/2010 | Lee et al. | |
| 2013/0240082 | A1 * | 9/2013 | Mueller | 141/7 |

FOREIGN PATENT DOCUMENTS

| | | | |
|---|---|---|---|
| EP | 2 179 926 | A1 | 4/2010 |
| WO | 93/19985 | A1 | 10/1993 |

* cited by examiner

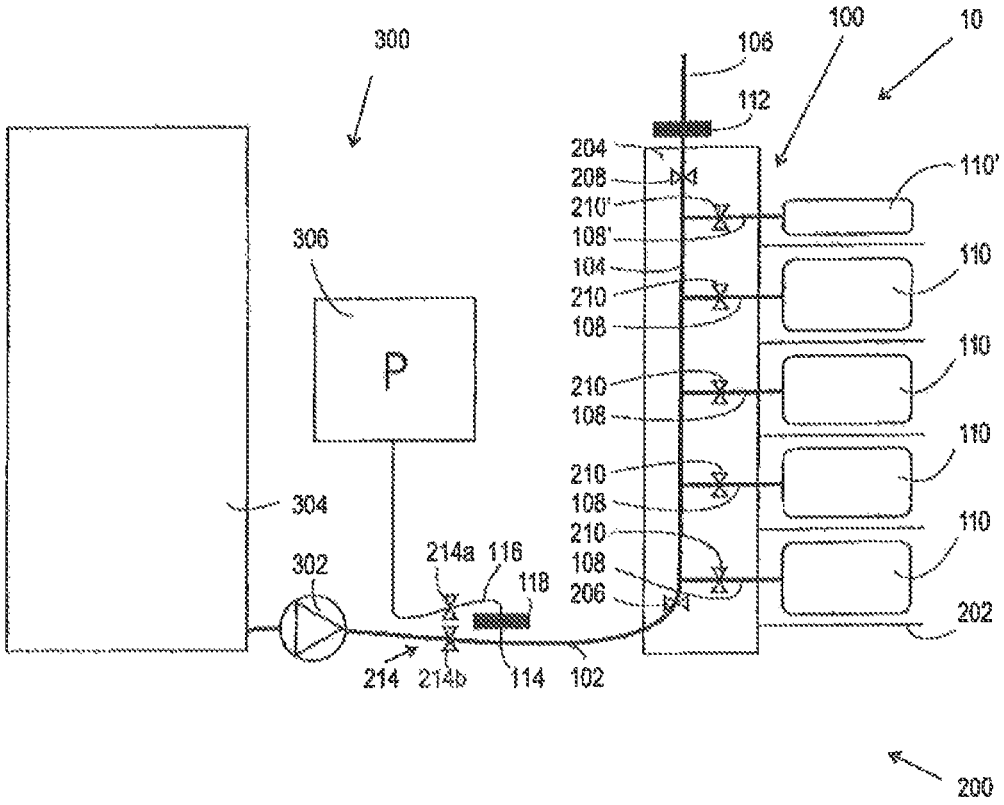
300
106
100
10
112
204
208
210'
108'
104
210
108
110'
110
110
110
110
306
P
304
302
214a
116
118
214
214b
114
102
202
200

FILLING SYSTEM AND FILLING METHOD

The present application is a Bypass Continuation of International Application No. PCT/EP2012/001141, filed on Mar. 14, 2012, which claims priority from German Patent Application No. 10 2011 001 584.1, filed on Mar. 28, 2011. The contents of these applications are hereby incorporated into the present application by reference in their respective entireties.

FIELD AND BACKGROUND OF THE INVENTION

The invention relates to a filling system comprising a filling apparatus and a container arrangement inserted into the filling apparatus, wherein the container arrangement comprises:

- a hose-like main line which comprises a feed line connected to a supply reservoir and a trunk line connected linearly downstream of the feed line, and
- a plurality of target containers, in particular flexible bags which are each connected to the trunk line via a hose-like connecting line and wherein the filling apparatus comprises:
- a support framework for mounting the target containers individually,
- a valve support with a plurality of target container valves corresponding to the plurality of target containers and with which, it is possible, in each case, to control a volume flow through one of the connecting lines.

The invention also relates to a filling method which makes use of a filling system of this type, wherein in a first filling step, through coordinated control of the valves of the valve support, one or more target containers are filled with fluid from the supply reservoir and at least one target container—which, below, is designated the residue container—remains unfilled.

Filling systems for filling manifolds are disclosed, for example, in EP 152 513 8B1. A manifold is taken here to mean a hose system which connects a plurality of containers to one another. Containers suitable for such filling systems include flexible bags, as well as rigid or semi-rigid containers, for example, bottles. The containers are linked via connecting lines to a common hose which, in the discussion below, is designated the trunk line. The trunk line is connected on one side to a feed hose and, on the other side, can be connected to a tapping-off hose. It can sometimes be difficult to draw a sharp border-line between the trunk line and the feed line or the discharge line in practice and the distinction should be understood, above all, in a functional sense in the context of the present description. The feed line essentially provides the connection to a supply reservoir, for example, a reservoir tank. The discharge line, where provided, serves to conduct away gas contained in the conductor line system or in the target containers during the filling process. The totality of the feed line, the trunk line and possibly the discharge line is here designated the main line.

For the filling, the manifold with the attached containers is placed into a special filling apparatus. There, the containers are arranged individually, in particular lying down or hanging in a support framework. The filling apparatus also comprises a valve support which can be fully or partially integrated into the aforementioned support framework. The valve support has a separately controllable valve, in particular a hose pinch valve, for each connecting line. With this, the connection of each target container to the trunk line can be established or prevented individually. Typically, the valve support also comprises a main valve with which the volume flow from the feed line to the trunk line is controlled and which, in practice, can be regarded as the functional border-line between the feed line and the trunk line.

For filling, in a preliminary flushing step, all the target container valves are closed and, with the main valve open (where provided), fluid is pumped from the supply reservoir into the trunk line until the trunk line is full, the gas in the trunk line being able to escape through the discharge line, when a discharge line is provided. The term pumping is to be understood in a broad sense in the present disclosure and comprises both true pumping processes and other, pressure-difference-related fluid transfer processes, e.g., those making use of gravity. Following the preliminary flushing, the target container valves are opened individually so that fluid can flow from the supply reservoir into the individual target containers. A fill level measurement can be carried out volumetrically or gravimetrically. In particular, the overall filling apparatus including the manifold can be positioned on an electronic balance, wherein the changes in the weighing values can provide information concerning the filling process and the corresponding electronic signals can be used as control signals in order to control the valves. As soon as a target container is filled, the corresponding target container valve is closed and the process is repeated with the next target container. After filling of the desired number of target containers, the containers are closed, for example, welded closed, and separated from the connecting lines.

A disadvantage of the known method is that a significant quantity of fluid remains in the trunk line and the connecting lines on the trunk line side of the target container valves. This disadvantage is more serious the more expensive the fluid is, wherein particularly in the biotechnology and medical domains, where manifolds are widely used, extremely costly fluids are handled.

From EP 0 632 775 B1, a filling system constructed with rigid pipelines is known which serves to fill bottles which are fed to the system by a conveyor belt feeding system in batches. For this purpose, the fluid for filling is firstly fed from a reservoir tank via a feed pipe into a horizontal distribution pipe from which a plurality of vertically downwardly extending outlet pipes, which are closed at the ends thereof with tip valves, emerge. Air in the distribution pipe can escape through an air outlet pipe connected at the end thereof. When preliminary flushing of the distribution pipe is carried out, the outlet pipes are also flushed out. Subsequently, the horizontal distribution pipe is emptied again in that the air outlet pipe is connected to a compressed air source and the inlet of the distribution pipe is decoupled from the feed pipe and is connected to a collecting tank. The fluid in the outlet pipes remains there, corresponding to a pre-dosing for the subsequent actual filling procedure. For this procedure, the input to the distribution pipe is closed and compressed air is fed to the end of the distribution pipe again, while at the same time, the tip valves of the outlet pipes are opened. The pre-dosed fluid in the outlet pipes is blown out into the bottles provided, which meanwhile have been positioned under the tip valves. At the same time, fluid gathering in the collecting tank, which meanwhile has been disconnected from the distribution pipe, is also blown, with the aid of compressed air, into the supply reservoir. This known system is not suitable for filling small volumes of costly, sterile fluids and is based, in essence, on initial excessive preliminary flushing and subsequent discarding of the residue. This necessarily requires the direct return of the residue to the supply reservoir; prior preparation (e.g. sterilization) or disposal of the residue is not economically viable due to the large volume of residue. However, return directly to the supply reservoir leads to a cyclic mixing of "old" and "fresh" fluid which, in the case of sensitive fluids, is not acceptable for hygiene reasons.

A system that is simplified relative to the aforementioned system is disclosed by DE 43 41 934 A1. Herein, the distribution pipe is always filled and pressurized; the pre-dosing into the outlet pipes is controlled via corresponding valves. The pressurization is achieved by pressurizing the supply reservoir.

A similar system in which, rather than a distribution pipe, a distribution tank is provided with outlet hoses attached thereto, is disclosed by DE 196 40 664 C1. Herein, the supply reservoir and the distribution tank are pressurized separately.

OBJECTS AND SUMMARY OF THE INVENTION

It is an object of the present invention to further develop a filling system of this type and a filling method of this type such that the fluid waste is substantially reduced.

According to one formulation, this object is achieved through a filling system in which, at a branching point in the region of the feed line, a branch line extends from the feed line to a pressurized gas source and in which the feed line and the branch line on the side of the branching point facing away from the trunk line extend through a double valve arrangement, having two hose pinch valves which are controllable in a manner contrary to one another, wherein one is arranged in the main line and the other is arranged in the branch line.

According to a further formulation, this object is achieved by passing, in a second filling step, residual fluid remaining in the main line to the residue container and by opening the associated target container valve, closing the trunk line is at the end thereof facing away from the branching point, closing the feed line with the associated hose pinch valve of the double valve arrangement, and opening the branch line with the associated hose pinch valve of the double valve arrangement, so that pressurized gas from the pressurized gas source forces the residual fluid into the residue container.

The invention is embodied in modifications of both the manifold and the filling apparatus. These modifications must be matched to one another.

In the inventive filling system, a branching point is provided in the region of the feed line, so that the actual feed line is connected to the supply reservoir as before and the emerging branch line is connected to the compressed gas source, for example, an air compressor.

In parallel with this, the filling apparatus, preferably the valve support thereof, is extended with a double valve arrangement, which is configured in a preferred embodiment as a common valve unit. This double valve arrangement comprises two hose pinch valves, in one of which the actual feed line is arranged and in the other of which the branch line is arranged. It is important herein that both the individual valves of the double valve arrangement can be controlled preferably independently, but at least fundamentally contrary to one another.

These modifications of the manifold and the filling apparatus which are matched to one another enable the trunk line to be coupled alternatively in the usual manner to the actual feed line or to the pressurized gas source. The latter option is selected according to the inventive method for concluding a filling process if the desired number of target containers is filled in the known manner and a residue container remains unfilled. In this state, the target container valve of the residue container is then opened, the feed line is closed and the connection to the pressurized gas container is established. The pressurized gas then pushes the residual fluid remaining in the trunk line into the residue container so that said fluid is kept secure and can be re-used in a suitable manner.

It is particularly favorable if the residue container is connected to the trunk line via the connecting line that is arranged furthest from the branching point. In this way, it is ensured that the greatest possible portion of the trunk line lies between the pressurized gas inlet and the residue container, so that the maximum quantity of residual fluid can be forced into the residue container.

In a preferred development of the invention, a gas-permeable sterile filter is integrated into the branch line. This ensures that no contamination can be caused in the interior of the hose system by the pressurized gas. The sterile filtration at this site also permits the use, additionally in sterile procedures, of a non-sterile pressurized gas source, for example, a conventional air compressor.

Alternatively or additionally to the arrangement of a sterile filter in the branch line, in a variant of the invention in which a tapping-off point from the main line is included and is arranged following the trunk line in a linear connection, the sterile filter can be integrated into the tapping-off point on the side of the branching point facing toward the trunk line. This arrangement of the sterile filter is particularly preferred because manifolds with tapping-off points often already have a sterile filter in the tapping-off point in order to prevent any contamination of the hose system and the fluid being caused by the tapping-off.

As is well known from the prior art, it can also be provided within the scope of the invention that the valve support also comprises a main valve with which a volume flow from the feed line to the trunk line can be controlled. However, in the context of the invention, a separate main valve can also be dispensed with if the individual valve of the double valve arrangement associated with the actual feed line is functionally configured so as to be able to assume the function of the conventional main valve. It can be favorable, in particular, if the functional main valve is able to control the volume flow in a plurality of steps.

A similar principle applies to a discharge valve. Therefore, as is known from the prior art, the valve support can further comprise a discharge valve with which a volume flow between the trunk line and the discharge line (where present) can be controlled. Here also, the individual valve of the double valve arrangement associated with the actual tapping-off point can, in essence, assume the function of the known discharge valve.

Further features and advantages of the invention are disclosed in the following description and the accompanying drawings.

BRIEF DESCRIPTION OF THE DRAWINGS

In the drawings:

FIG. 1 is a schematic view of a first embodiment of an inventive filling system.

DETAILED DESCRIPTION OF EXEMPLARY EMBODIMENTS

The following description is directed to a particular embodiment wherein the target containers including the residue container are configured as flexible bags. However, the invention is also suitable for embodiments in which a plurality of, or even all, of the target containers are configured as rigid or semi-rigid containers, for example, as bottles.

The filling system 10 comprises a manifold 100 and a filling apparatus 200. A device periphery 300 is also shown in the FIGURE.

The manifold 100 comprises a main line which consists of a feed line 102, a trunk line 104 connecting thereto and a tapping-off line 106 connecting thereto. A plurality of connecting lines 108 and a residue bag connecting line 108' branch off from the trunk line (104). The differentiation between the connecting lines 108 and the residue bag connecting line 108' is made here merely for the purpose of simplifying the description. The connecting lines 108 each connect the trunk line 104 to a bag 110; the residue bag connecting line 108' connects the trunk line 104 to a residue bag 110'. The differentiation between the bags 110 and the residue bag 110' is made here merely for the purpose of simplifying the description.

The feed line 102 of the manifold 100 is connected via a pump 302 to a supply reservoir 304, for example, a tank. In the embodiment shown, the tapping-off line 106 from the manifold 100 has an integrated sterile filter 112.

The manifold 100 is integrated into a filling apparatus and has a support framework 202 for individual mounting of the bags 110, 110'. In the embodiment shown, the support framework 202 is coupled to a valve column 204 which carries a plurality of valves. The transition region between the feed line 102 and the trunk line 104 is therefore connected into a main valve 206 which is configured as a hose pinch valve. The transition region between the trunk line 104 and the tapping-off line 106 is therefore also inserted into a discharge valve 208 which is likewise configured as a hose pinch valve. Each connecting line 108 is also inserted into a bag valve 210 which is also configured as a hose pinch valve. The residue bag connecting line 108' is arranged within a residue bag valve 210' which is also configured as a hose pinch valve.

The entire apparatus is preferably mounted on an electronic balance (not shown) which is configured for gravimetric fill level monitoring and for corresponding output of control signals for the individual valves.

A pressurized gas source 306, specifically an air compressor, is shown in the FIGURE. The specific coupling of the pressurized gas source 306 is an significant aspect of the present invention.

In the embodiment of FIG. 1, the feed line 102 has a branching point 114 at which a branch line 116 extends off from the feed line 102. The branch line 116 is connected to the pressurized gas source 306. The branch line also passes through a first individual valve 214*a* of a double valve arrangement 214, configured as a hose pinch valve. On the supply reservoir side of the branching point 114, the feed line 102 passes through a second single valve of the double valve arrangement 214, also configured as a hose pinch valve 214*b*.

Arranged in the branch line 116 is a sterile filter 118 which filters out any microbes possibly contained in the pressurized gas and protects the manifold 100 against contamination.

During a filling procedure, the first individual valve 214*a* of the valve arrangement 214 is closed. The filling procedure takes place in a known manner until the bags 110 are filled and the associated bag valves 210 are closed. Typically, the discharge valve 208 is closed at this time point. In order that fluid remaining in the trunk line 104 and partially also in the feed line 102 should not have to be discarded, in a subsequent step, the second individual valve 214*b* of the valve arrangement 214 is closed and the residue bag valve 210' and the first individual valve 214*a* of the double valve arrangement 214 are opened. As a result, pressurized gas flows from the pressurized gas source 216, via the branching point 114 into the feed line 102 and pushes the residual fluid remaining in the feed line 102 and the trunk line 104 into the residue bag 110'. Subsequently, the residue bag valve 210' and the first individual valve 214*a* of the double valve arrangement 214 are closed, such that, with the trunk line 104 empty, the residue bag 110' and the remaining bags 110 can be separated and passed on to any desired further treatment.

It should be understood that the embodiments covered by the description above and shown in the FIGURE are merely illustrative exemplary embodiments of the present invention. A broad spectrum of possible variations will be apparent to a person skilled in the art, based on the present disclosure. In particular, the number, form, size and relative arrangement of the bags 110, 110' within the manifold 100 can be adapted to the requirements of an individual case. The applicant seeks to cover all such changes and modifications as fall within the scope of the invention, as originally disclosed and defined by the appended claims.

The invention claimed is:

1. A filling system comprising a filling apparatus and a container arrangement arranged in the filling apparatus, wherein the container arrangement comprises:

a main line which comprises a feed line connected to a supply reservoir and a pump, and a trunk line connected in linearly downstream of the feed line, and a plurality of target containers, which are each connected to the trunk line via a connecting line, and wherein the filling apparatus comprises:

a support framework configured to mount the target containers, a valve support comprising a plurality of target container valves corresponding respectively to the plurality of target containers and with which a volume flow through respective ones of the connecting lines is controlled, wherein at a branching point in a region of the feed line, a branch line branches from the feed line, and the feed line and the branch line on a side of the branching point facing away from the trunk line extend through a double valve arrangement, having two pinch valves which are configured to be controlled contrary to one another, the feed line being connected into one pinch valve and the branch line being connected into the other pinch valve, and wherein the branching point is arranged on a side of the pump toward the trunk line and the branch line extends to a pressurized gas source.

2. The filling system as claimed in claim 1, wherein a gas-permeable sterile filter is integrated into the branch line.

3. The filling system as claimed in claim 1, wherein the main line further comprises a tapping-off line which is connected linearly downstream of the trunk line.

4. The filling system as claimed in claim 3, wherein the valve support further comprises a discharge valve configured to control a volume flow between the trunk line and the tapping-off line.

5. A filling method using a filling system as claimed in claim 3, comprising filling, through coordinated control of the valves of the valve support, at least one target container with fluid from the supply reservoir such that at least one residue container remains unfilled, passing residual fluid remaining in the main line to the residue container, opening the target container valve associated with the residue container, closing the trunk line at the end thereof facing away from the branching point, closing the feed line with the pinch valve of the double valve arrangement associated with the feed line, and opening the branch line with the pinch valve of the double valve arrangement associated with the branch line, such that pressurized gas from the pressurized gas source forces the residual fluid into the residue container.

6. The method as claimed in claim 5, wherein the residue container is connected to the trunk line via the connecting line that is arranged linearly most distant from the branch point.

7. The filling system as claimed in claim 1, wherein the valve support further comprises a main valve configured to control a volume flow from the feed line to the trunk line.

* * * * *